US008889571B2

(12) United States Patent
Meyer et al.

(10) Patent No.: US 8,889,571 B2
(45) Date of Patent: Nov. 18, 2014

(54) WIRE CLOTH

(75) Inventors: Frank Meyer, Bad Laer (DE); Stefan Butenkemper, Sendenhorst (DE); Alexander Mantler, Oelde (DE)

(73) Assignee: Haver & Boecker OHG, Oelde (DE)

( * ) Notice: Subject to any disclaimer, the term of this patent is extended or adjusted under 35 U.S.C. 154(b) by 616 days.

(21) Appl. No.: 12/956,406

(22) Filed: Nov. 30, 2010

(65) Prior Publication Data

US 2011/0290369 A1 Dec. 1, 2011

(30) Foreign Application Priority Data

Dec. 2, 2009 (DE) ..... 10 2009 044 740

(51) Int. Cl.

| | |
|---|---|
| ***D03D 15/02*** | (2006.01) |
| ***D06C 15/00*** | (2006.01) |
| ***D03D 15/00*** | (2006.01) |
| ***D06C 7/00*** | (2006.01) |
| ***D03D 9/00*** | (2006.01) |

(52) U.S. Cl.

CPC *D06C 7/00* (2013.01); *D06C 15/00* (2013.01); *D03D 15/0094* (2013.01); *D03D 15/02* (2013.01); *D03D 9/00* (2013.01)

USPC ..... 442/6; 442/19; 442/203; 442/208; 442/229

(58) Field of Classification Search

USPC ..... 442/1, 203, 208, 229, 6, 19

See application file for complete search history.

(56) References Cited

U.S. PATENT DOCUMENTS

| | | | | |
|---|---|---|---|---|
| 3,658,099 | A * | 4/1972 | Daringer | 139/425 R |
| 6,045,926 | A * | 4/2000 | Van De Velde et al. | 428/606 |
| 7,196,025 | B2 * | 3/2007 | Sahlin et al. | 442/246 |
| 7,279,436 | B2 * | 10/2007 | Pintz | 442/43 |
| 7,341,076 | B2 * | 3/2008 | Braekevelt et al. | 139/50 |
| 2004/0091685 | A1 * | 5/2004 | John et al. | 428/196 |
| 2009/0114597 | A1 * | 5/2009 | Cronia et al. | 210/660 |

FOREIGN PATENT DOCUMENTS

| | | | |
|---|---|---|---|
| CA | 879481 | A * | 12/1969 |
| DE | 1 291 695 | | 3/1934 |
| DE | 1 684 829 | | 10/1954 |
| DE | 29 34 782 | | 3/1980 |
| DE | 102007013722 | | 9/2008 |

* cited by examiner

*Primary Examiner* — Elizabeth Cole
(74) *Attorney, Agent, or Firm* — Henry M Feiereisen LLC

(57) ABSTRACT

A wire cloth includes warp wires and weft wires which cross each other and are interwoven by a weave pattern. The warp wires are formed in at least two different configurations to define warp wires of first and second types. A length of the first type of warp wires deviates from a length of the second type of warp wires in relation to a particular length unit, with pores being formed in interstices between sections of two neighboring warp wires and crossing sections of two neighboring weft wires.

21 Claims, 5 Drawing Sheets

Fig. 1
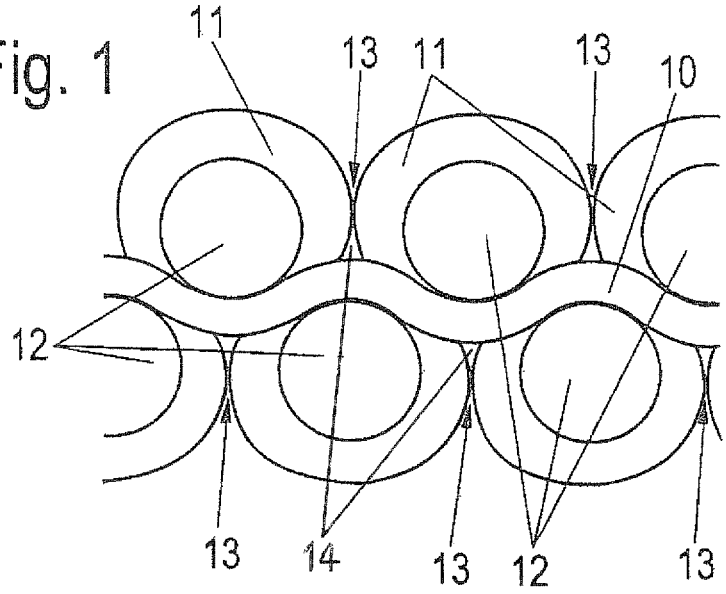
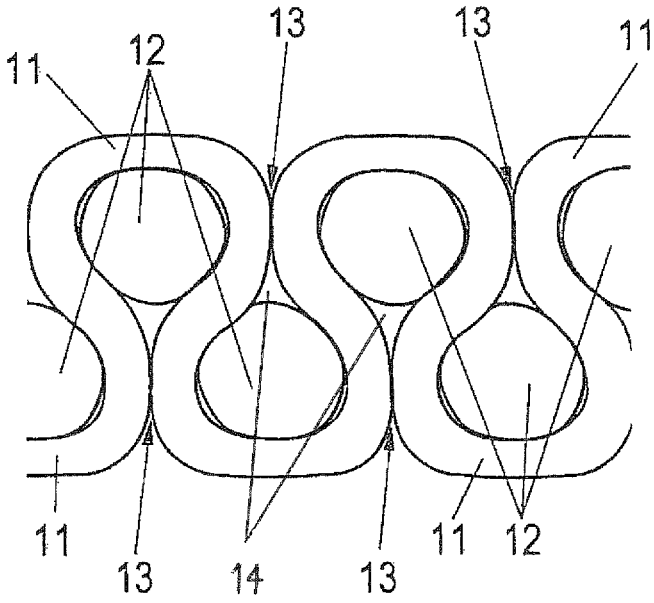
Fig. 2

WIRE CLOTH

CROSS-REFERENCES TO RELATED APPLICATIONS

This application claims the priority of German Patent Application, Serial No. 10 2009 044 740.7, filed Dec. 2, 2009, pursuant to 35 U.S.C. 119(a)-(d), the content of which is incorporated herein by reference in its entirety as if fully set forth herein.

BACKGROUND OF THE INVENTION

The present invention relates to a wire cloth having warp wires and weft wires interwoven with one another.

The following discussion of related art is provided to assist the reader in understanding the advantages of the invention, and is not to be construed as an admission that this related art is prior art to this invention.

Wire cloths can be used in a wide variety of applications, e.g. as filter cloth or as screen cloth. In particular, when using a filter cloth, the efficiency is dependent on the throughflow rate. Conventional wire cloths have warp and weft wires have a course that is always constant, regardless of the weave pattern. An increase of the throughflow rate is at the expense of the filter fineness, i.e. the size of the pores formed by the crossing warp and weft wires is increased.

It would be desirable and advantageous to provide an improved wire cloth which obviates prior art shortcomings and which is configured to improve filter fineness while maintaining throughflow rate, i.e. particles to be filtered out have smaller size, or to increase throughflow rate while maintaining filter fineness.

SUMMARY OF THE INVENTION

According to one aspect of the present invention, a wire cloth includes warp wires and weft wires crossing each other and interwoven by a weave pattern, with the warp wires being formed in at least two different configurations to define warp wires of first and second types, wherein a length of the first type of warp wires deviates from a length of the second type of warp wires in relation to a particular length unit, wherein pores are formed in interstices between sections of two neighboring warp wires and crossing sections of two neighboring weft wires.

Different lengths of the warp wires are realized during production of the wire cloth. This process is labeled as lengthening in different manner. As a result, warp wires which undergo less lengthening are not deformed or deformed only insignificantly. Conversely, the warp wires which undergo greater lengthening are deformed to a greater extent. As a result, the distances between the weft wires become greater so that the throughflow rate increases.

A wire cloth according to the present invention may find application in particular as filter cloth that exhibits enhanced throughflow, as screen cloth, and as transport belt. Other examples of application involve screen printing, or use as catalyst, or as heat exchangers with enhanced surface contact compared to conventional wire cloths. Wear is reduced in particular when screen printing is involved. Use in acoustics is also conceivable, or use in the electronic field, e.g. as contact polarity. Depending on the need at hand, plastic material may also be injected into the wire cloth or synthetic resin may be embedded into the wire cloth. Another benefit of a wire cloth according to the present invention involves that the distance between wire cloth crests, utilized as contact to other componentries, can be precisely maintained. Another application of a wire cloth according to the invention involves the field of design and architecture.

According to another advantageous feature of the present invention, a longer one of the first and second types of the warp wires can loop around the weft wires by substantially 360°, with confronting sections of two spaced-apart warp wires touching one another. As a result, a number of pores can be provided in the interstices between the warp and weft wires.

The mass of a wire cloth according to the invention and its properties improve sound absorption as well as heat absorption and heat emission.

According to another advantageous feature of the present invention, the wire cloth may be compacted by calendering. The warp wires may also be manufactured with different tensile stress. For reasons of stabilization, a wire cloth according to the invention may undergo a thermal treatment, e.g. sintering.

According to another advantageous feature of the present invention, the first and second types of warp wires may have a waved configuration of different degrees to define warp wires of low waviness and warp wires of high waviness. Suitably, the warp wires of first and second types of warp wires may define an alternating pattern of a warp wire of low waviness followed by a warp wire of high waviness. It may also be conceivable that the warp wires of first and second types of warp wires define in direction of the weft wires a pattern in which a number of warp wires of low waviness can follow one another and a number of warp wires of high waviness can follow one another.

The terms "low waviness" and "high waviness" as used in the disclosure relate to wave heights that significantly deviate from one another. Currently preferred is a configuration in which the wave height of the warp wires of high waviness is a multiple of a wave height of the warp wires of low waviness.

As described above, the warp wires can thus be made in two configurations that differ in the degree of their waviness, i.e. warp wires of low waviness and warp wires of high waviness which may alternate in the pattern. As an alternative, it may be suitable, to provide, as viewed in direction of the weft wires, a pattern in which a number of warp wires of low waviness alternates with a number of warp wires of high waviness. The number of warp wires of low waviness may hereby differ from the number of warp wires of high waviness.

The particular configuration of a wire cloth according to the present invention is dependent on the situation at hand. Currently preferred is a pattern in which the weft wires are placed in alternating vertically offset relationship.

According to another advantageous feature of the present invention, the warp wires of first and second types of warp wires may be made of same or different material. The warp wires and the weft wires may also be made of same or different material.

According to another advantageous feature of the present invention, the warp wires of first and second types of warp wires may have same or different diameter. The warp wires and the weft wires may also have same or different diameter.

According to another advantageous feature of the present invention, the warp and weft wires may each be made of a single wire or a monofilament or multifilaments.

According to another advantageous feature of the present invention, the warp and weft wires may be defined by a diameter between 16 microns to 1.6 mm.

According to another advantageous feature of the present invention, the warp wires of first and second types of warp wires define a pattern in which the number of warp wires of first and second types of warp wires may vary, with the weft wires woven substantially planar.

According to another advantageous feature of the present invention, the wire cloth may have a surface which is coated or embedded in a synthetic resin. The coating may hereby be applied on individual or several warp wires and/or weft wires.

A wire cloth according to the present invention may have a varying surface weight and thus a varying surface by changing the ratio of warp wires of low waviness to warp wires of high waviness. The wire cloth may be woven in many weave patterns, e.g. twill weave, satin weave, and the like. Braid weave on the other hand is not possible or can be realized only with great difficulty. Floating may also be conceivable.

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 1 is a partial end view of a wire cloth according to the present invention, as viewed in a direction of a warp wire which is deformed with low waviness;

FIG. 2 is a partial end view of the wire cloth, as viewed in a direction of a warp wire which is deformed with high waviness;

DETAILED DESCRIPTION OF PREFERRED EMBODIMENTS

Figure 3:
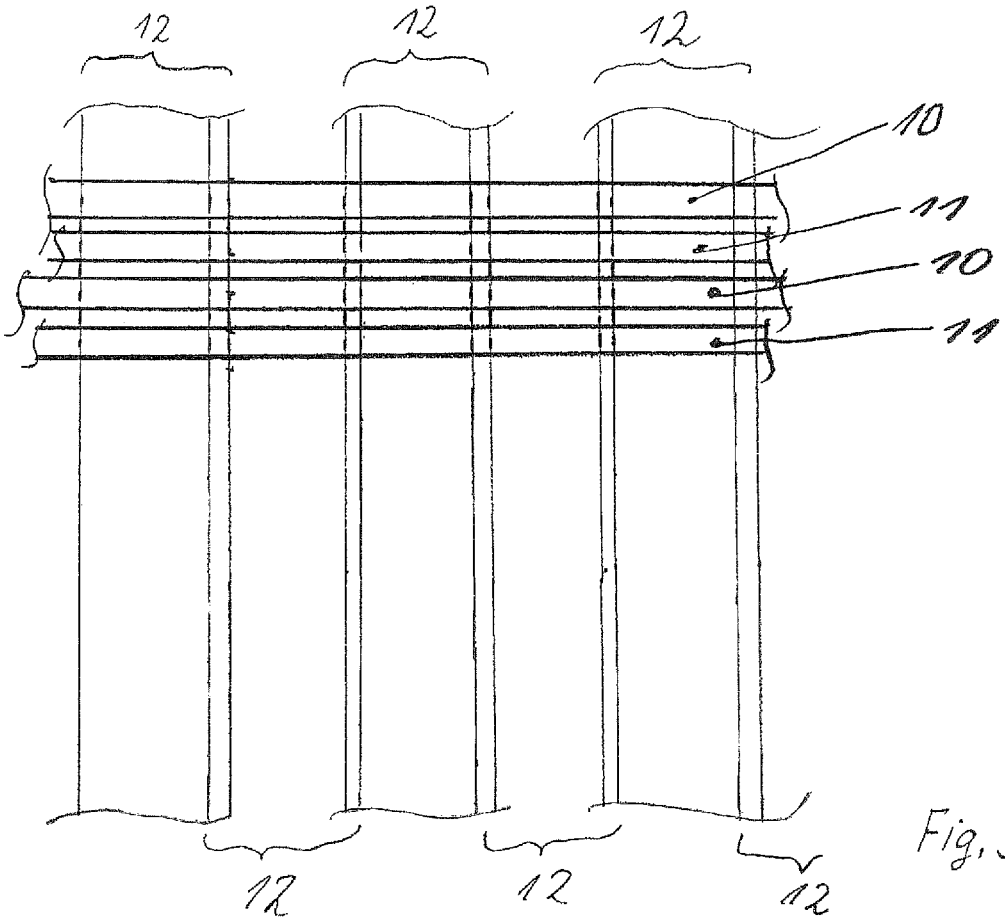
FIG. 3 is a plan view of one weaving pattern of the warp wires of the wire cloth.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a partial end view of a wire cloth according to the present invention, comprised of a plurality of warp wires 10, 11 arranged in spaced-apart relationship and a plurality of weft wires 12 which are also arranged in spaced-apart relationship and crossing the warp wires 10, 11. The warp wires 10, 11 and the weft wires 12 are interwoven by known wave patterns. As shown in FIG. 1, the warp wire 10 is deformed with a slight waviness whereas the warp wire 11 is deformed with a more pronounced waviness, referred to in the description as "low waviness" and "high waviness", respectively. As shown in particular in FIG. 2, the warp wire 11 loops around the respective weft wires 12 by an angle of nearly 360°. As indicated in FIGS. 1 and 2 by reference numeral 13, the warp wires 11 are so deformed that sequential deformations of the warp wires 11 touch one another. Comparing FIGS. 1 and 2 also shows that the wavily deformed sections of the warp wire 11 have a wave height which is a multiple of a wave height of the wavily deformed sections of the warp wire 10.

The warp wires 11 have a length which is greater than a length of the warp wires 10. This is realized during the course of weaving the wire cloth. Interstices formed by the intersecting warp and weft wires 10, 11, 12 are partly closed and thus include pores 14, as a result of the presence of warp wires 10, 11 which are deformed to a different degree and thus lead to an increase in the distances of the weft wires 12.

The warp wires 10, 11 may be made of same or different material. Also, the warp wires and the weft wires may also be made of same or different material. Examples of a suitable material include steel, in particular steel with relatively high elongation capability, or non-corrosive steel alloys.

FIG. 3 shows the warp wires 10, 11 arranged in an alternating pattern, i.e. an alternating pattern of low waviness (warp wires 10) and high waviness (warp wires 11).

Figure 4:
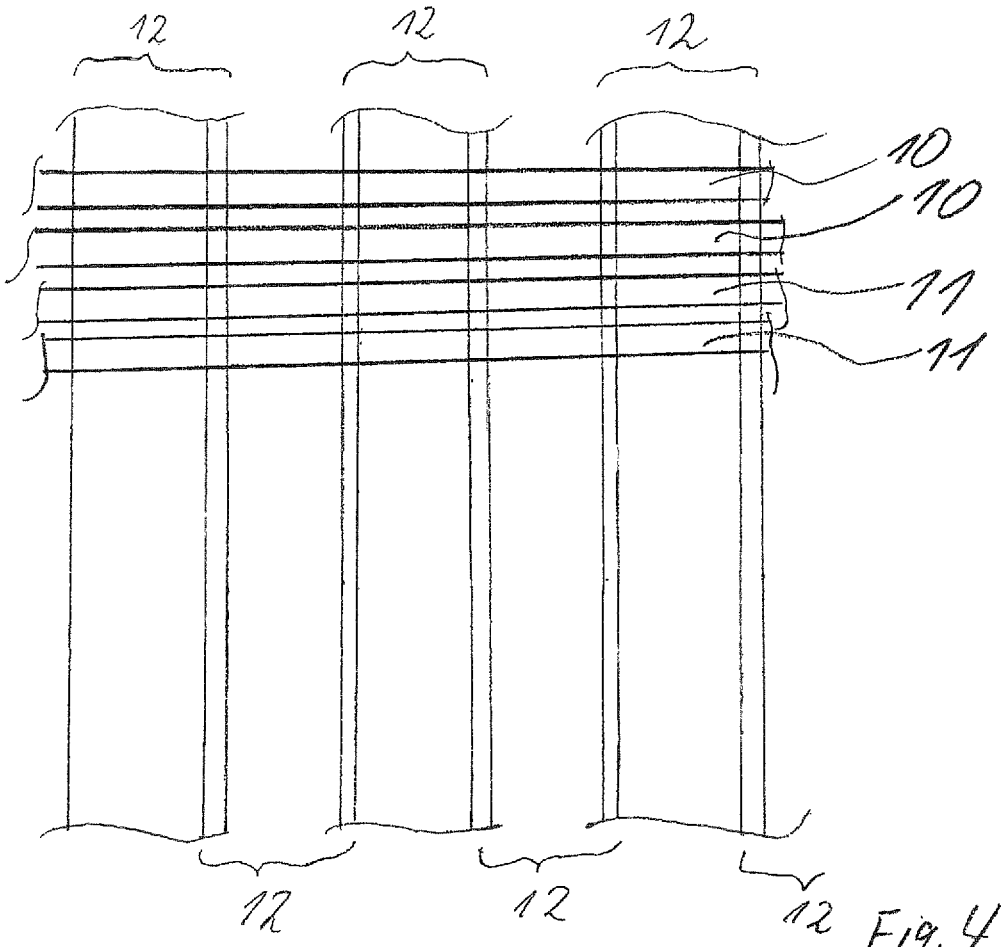
FIG. 4 is a plan view of another weaving pattern of the warp wires of the wire cloth.
Figure 5:
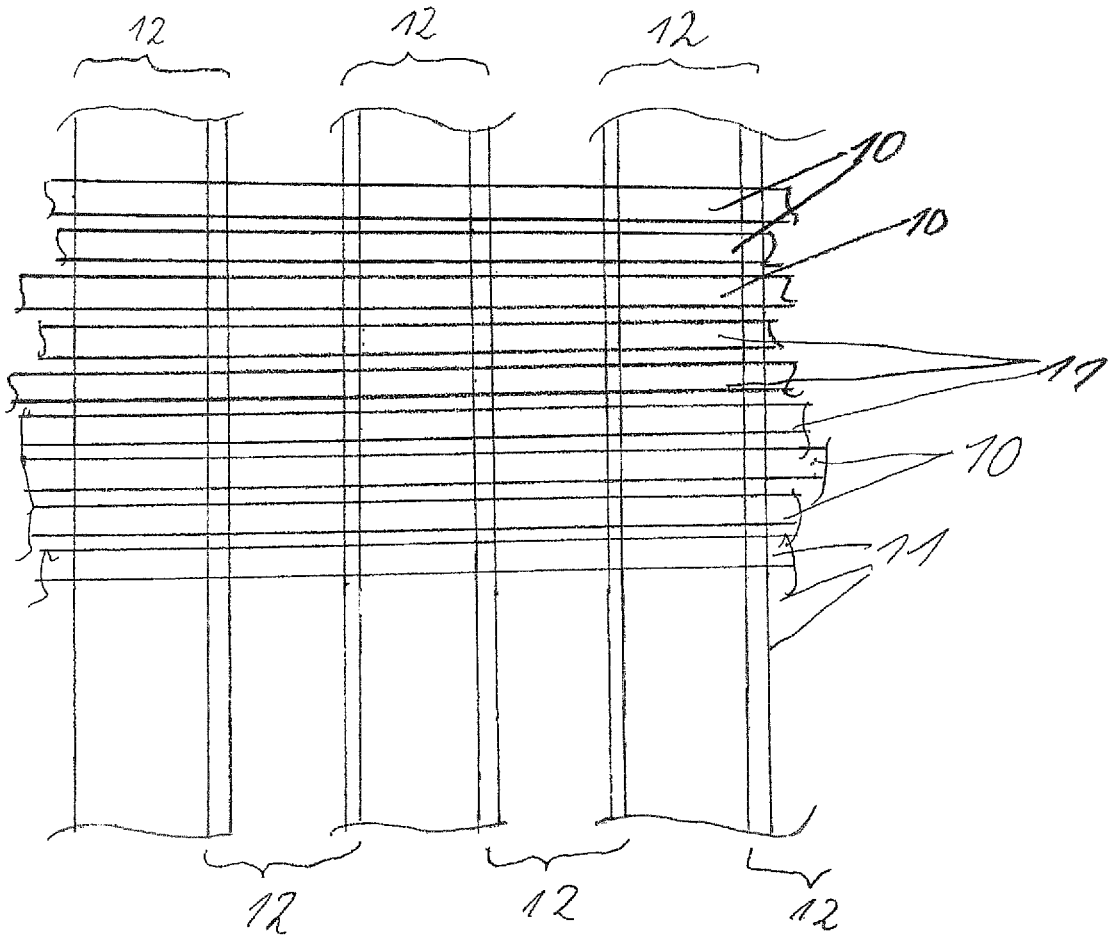
FIG. 5 is a plan view of yet another weaving pattern of the warp wires of the wire cloth.

FIG. 4 is a plan view of another weaving pattern of the warp wires 10, 11 of the wire cloth, in which a same number of warp wires 10 of low waviness is followed by a same number of warp wires 11 of high waviness. FIG. 5 shows a weaving pattern of the warp wires 10, 11 of the wire cloth, in which the number of successive warp wires 10 of low waviness is different than the number of successive warp wires 11 of high waviness.

Figure 6:
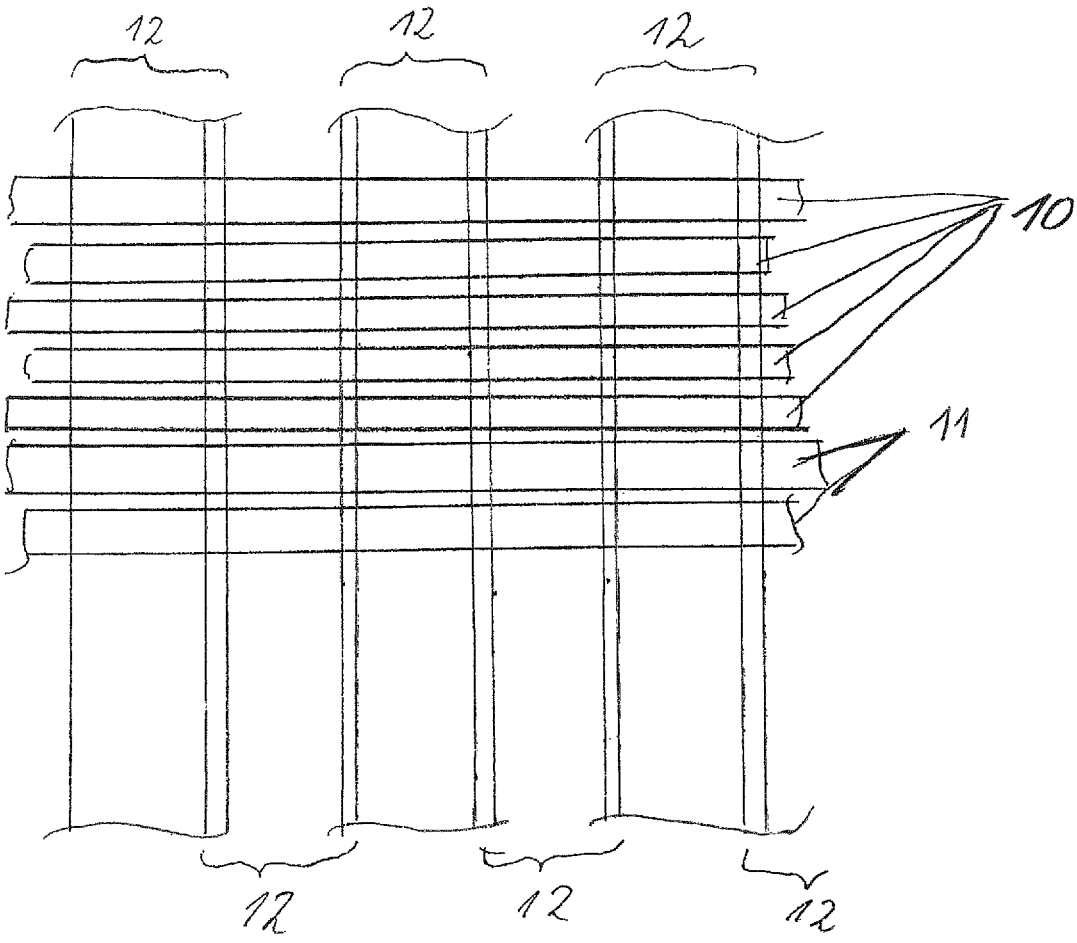
FIG. 6 is a plan view of still another weaving pattern of the warp wires of the wire cloth.

FIG. 6 is a plan view of still another weaving pattern in which the warp wires 10, 11 of the wire cloth have different diameter. Warp wires 10, 11 extend in parallel relationship.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A wire cloth, comprising warp wires and weft wires crossing each other and interwoven by a weave pattern, said warp wires being formed in at least two different configurations to define warp wires of first and second types, said warp wires of the first type extending in parallel relationship with the warp wires of the second type, wherein a length of the first type of warp wires deviates from a length of the second type of warp wires in relation to a particular length unit, wherein pores are formed in interstices between sections of two neighboring warp wires and crossing sections of two neighboring weft wires, wherein a longer one of the first and second types of the warp wires loops around each of the weft wires by substantially 360°.

2. The wire cloth of claim 1, wherein the wire cloth is treated by at least one process consisting of compacting and stabilization by thermal treatment.

3. The wire cloth of claim 2, wherein the compacting process is executed by calendering.

4. The wire cloth of claim 2, wherein the stabilization process is executed by sintering.

5. The wire cloth of claim 1, wherein the first and second types of warp wires have a waved configuration of different degrees to define warp wires of low waviness and warp wires of high waviness.

6. The wire cloth of claim 5, wherein a wave height of the warp wires of high waviness is a multiple of a wave height of the warp wires of low waviness.

7. The wire cloth of claim 5, wherein the warp wires of first and second types of warp wires define an alternating pattern of low waviness and high waviness.

8. The wire cloth of claim 5, wherein the warp wires of first and second types of warp wires define in direction of the weft wires a pattern in which a number of warp wires of low waviness follow one another and a number of warp wires of high waviness follow one another.

9. The wire cloth of claim 5, wherein the warp wires of first and second types of warp wires define in direction of the weft wires a pattern in which a number of warp wires of low waviness is different than a number of warp wires of high waviness.

10. The wire cloth of claim 1, wherein the weft wires are placed in alternating vertically offset relationship.

11. The wire cloth of claim 1, wherein the warp wires of first and second types of warp wires are made of a same material.

12. The wire cloth of claim 1, wherein the warp wires of first and second types of warp wires are made of different material.

13. The wire cloth of claim 1, wherein the warp wires and the weft wires are made of a same material.

14. The wire cloth of claim 1, wherein the warp wires and the weft wires are made of different material.

15. The wire cloth of claim 1, wherein the warp wires of first and second types of warp wires have a same diameter.

16. The wire cloth of claim 1, wherein the warp wires of first and second types of warp wires have different diameter.

17. The wire cloth of claim 1, wherein the warp wires and the warp wires have a same diameter.

18. The wire cloth of claim 1, wherein the warp wires and the weft wires have different diameter.

19. The wire cloth of claim 1, wherein the warp wires and the weft wires have a diameter in a range between 16 microns to 1.6 mm.

20. The wire cloth of claim 1, wherein the warp wires of first and second types of warp wires define a pattern in which the number of warp wires of first and second types of warp wires varies, with the weft wires woven substantially planar.

21. The wire cloth of claim 1, wherein individual warp wires and/or weft wires may have a surface which is coated or embedded in a synthetic resin.

* * * * *